United States Patent [19]

Fantozzi

[11] 4,341,461

[45] Jul. 27, 1982

[54] DEVELOPMENT CONTROL OF A REPRODUCTION MACHINE

[75] Inventor: Louis J. Fantozzi, Penfield, N.Y.

[73] Assignee: Xerox Corporation, Stamford, Conn.

[21] Appl. No.: 137,710

[22] Filed: Apr. 7, 1980

[51] Int. Cl.[3] ..... G03G 15/00

[52] U.S. Cl. ..... 355/14 D; 355/14 C; 118/664

[58] Field of Search ..... 355/14 D, 14 C, 3 DD, 355/10, 11, 77; 118/663, 664, 681; 430/102, 103, 119, 120, 122

[56] References Cited

U.S. PATENT DOCUMENTS

| | | | |
|---|---|---|---|
| 3,765,778 | 10/1973 | Bey et al. | 355/77 X |
| 3,788,739 | 1/1974 | Coriale | 355/14 C |
| 3,876,106 | 4/1975 | Rowell et al. | 355/3 DD X |
| 4,003,650 | 1/1977 | Courtney et al. | 355/14 D |
| 4,153,364 | 5/1979 | Suzuki et al. | 355/14 D X |
| 4,200,391 | 4/1980 | Sakamato et al. | 355/3 DD X |
| 4,213,693 | 7/1980 | Imai et al. | 355/14 D |
| 4,256,401 | 3/1981 | Fujimura et al. | 355/14 D X |

FOREIGN PATENT DOCUMENTS

| | | | |
|---|---|---|---|
| 54-6561 | 1/1979 | Japan | 355/14 D |
| 1559341 | 1/1980 | United Kingdom | 355/14 D |

*Primary Examiner*—J. V. Truhe
*Assistant Examiner*—Richard M. Moose
*Attorney, Agent, or Firm*—Ronald F. Chapuran

[57] ABSTRACT

The present invention is a sample data control system having a toner dispensing control loop regulating toner flow using a sensor approach directly measuring developed images to eliminate toner mass variations, and a bias control loop maintaining optimum density images on the photoreceptor in spite of changing humidity conditions. Two test targets, each having two test patches are selectively exposed to provide test data in the photoreceptor image area for suitable sensing and control of the toner dispensing and bias control loops.

4 Claims, 15 Drawing Figures

150
ENABLE / DISABLE TONER DISP
RESET
NORMAL BIAS REF.
142
SUMMING AMP.
96
BIAS CONTROL
DEV ROLL
136
COMPARATOR
C
B
134
SAMPLE + HOLD
PRE-COPY STROBE
132
COMPARATOR
HIGH DENSITY BIAS CONTROL REF. VOLT.
SENSOR 92
130
P/R NORMALIZATION VOLTAGE
138
INTEG.
148
SAMPLE + HOLD
146
SUMMING AMP.
140
SAMPLE + HOLD
COPY STROBE
144
COMPARATOR
NORMAL DENSITY REF.

DEVELOPMENT CONTROL OF A REPRODUCTION MACHINE

This invention relates to a reproduction machine and in particular to an improved method and apparatus for the automatic control of development.

Closed loop control and adjustment of particular reproduction machine parameters is generally well known. For example, U.S. Pat. No. 2,956,487 generally discloses that individual control signals can be used to adjust operating elements of a reproduction machine such as controlling the developer through control of the developer powder ratio and the magnetic brush bias.

Other systems are disclosed in U.S. Pat. Nos. 4,179,213; 3,348,522; 3,348,523 and 3,376,853. In particular, a clean drum signal is compared to a signal reflected from a test pattern formed on the drum. Separate sensors are used for detecting each signal. The outputs of the sensor are compared by a bridge circuit to provide an error signal, and a toner dispenser is operated in response to the error signal. In these systems, the degree of development is measured directly from a developed test stripe on the photoreceptor drum extending along the peripheral edge of the drum and in some cases, extending into the photoreceptor image area.

In systems such as shown in U.S. Pat. Nos. 3,873,002 and 4,065,031, an electrically biased transparent electrode disposed on the photoreceptor surface is conveyed past the development station to attract toner particles. Light is transmitted from within the photoreceptor through the transparent electrode and detected by a photosensor located near the photoreceptor surface. The photosensor provides a signal indicative of the density of toner particles on the transparent electrode.

Other systems control toner dispensers by measuring toner concentration in the developer mixture contained in a developer housing or reservoir, for example, U.S. Pat. No. 3,233,781. Other systems such as disclosed in U.S. Pat. No. 3,719,165 control a toner replenisher by measuring the electric potential of a magnetic developing brush. In other approaches to improved toning, the potential of an electrode in the development station is adjusted as a function of the charge density of the electrostatic image. For example, U.S. Pat. No. 3,779,204 teaches the use of an electrometer probe disposed near a photoreceptor belt to provide auto bias and also produces a signal to actuate a toner dispenser through threshold circuitry.

A difficulty with the prior art systems is that, in general, they adjust only one parameter out of a variety of parameters that affect the machine developer and copy quality.

However, in providing optimum copy quality in the development process in a xerographic machine environment, various factors dealing with development must be considered. These factors include photoreceptor thickness, fatigue and temperature, developer age and high humidity conditions. In the case of development, for example, high humidity conditions cause excessively high density developed images and variations in line and solid area density relationships.

In addition to the difficulty of compensating for a variety of changes in characteristics, prior art systems are often only analogs, that is, do not directly monitor conditions, for example, the amount of toner mass developed on the photoreceptor surface in the image area. Even if providing for adjustment of a plurality of parameters, many systems require continuous sampling outside the image area and do not provide for the flexibility and concise adjustment provided by a sample data system with measurements taken in the image area.

It would be desirable therefore to provide a control system that adjusts for these various factors affecting developer copy quality using sampled data that is directly related to the parameter to be controlled and a control that is applicable to a wide variety of machine environments.

It is therefore an object of the present invention to provide a new and improved xerographic control system which accurately compensates for changes in a variety of characteristics to maintain optimum developer copy quality over a wide range of machine environments.

Briefly, the present invention is concerned with a sample data control system having a toner dispensing control loop regulating toner flow using a sensor approach directly measuring developed images to eliminate toner mass variations, and a bias control loop maintaining optimum density images on the photoreceptor in spite of changing humidity conditions. Two test targets, each having two test patches are selectively exposed to provide test data in the photoreceptor image area for suitable sensing and control of the toner dispensing and bias control loops.

For a better understanding of the present invention, reference is made to the accompanying drawings wherein the same reference numerals have been applied to like parts and wherein.

Figure 2:
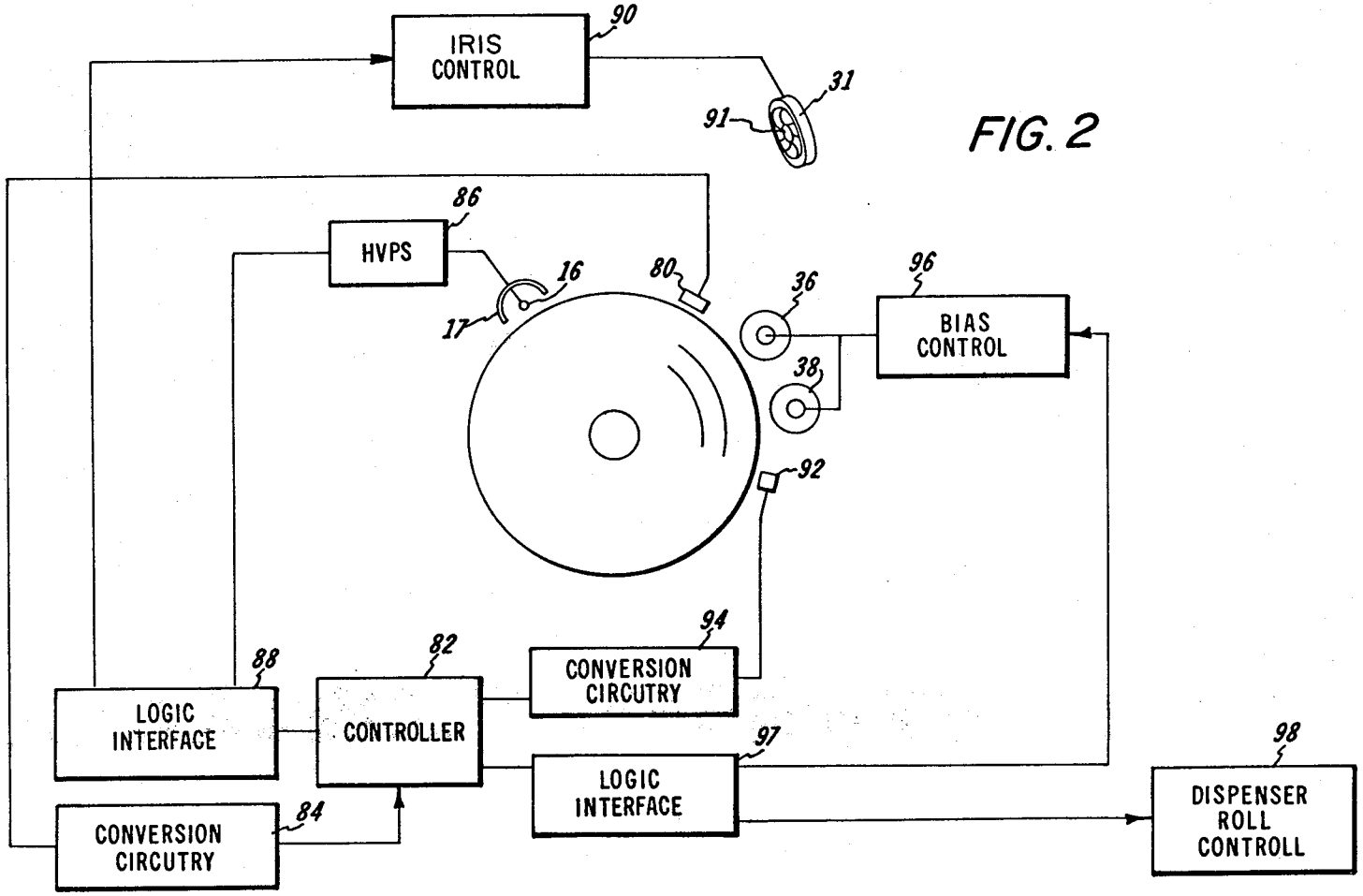
FIG. 2 is a block diagram illustration of the control loops in accordance with the present invention.
Figure 4A:
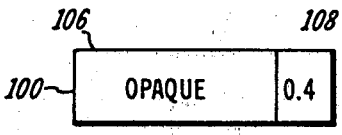
Figure 4B:
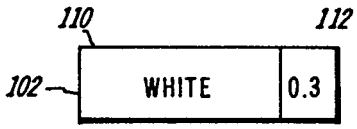
Figure 5A:
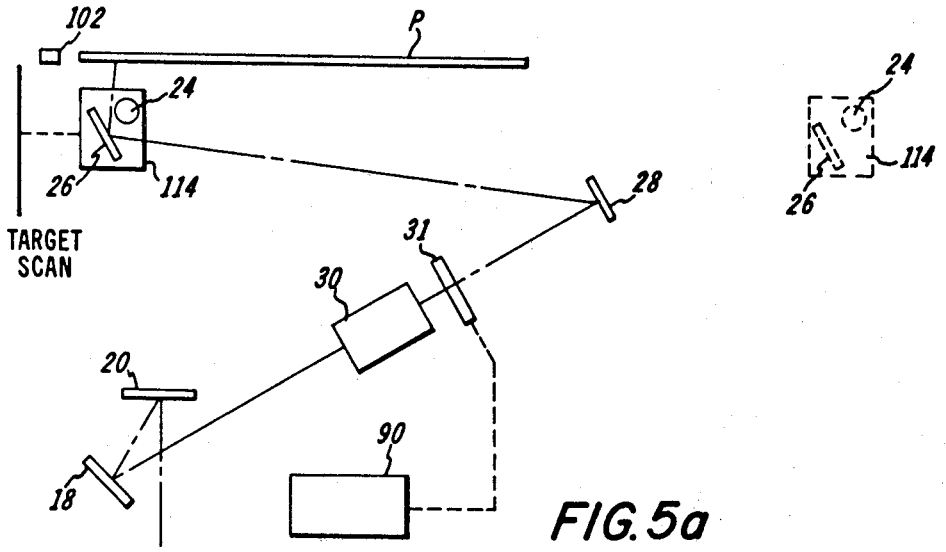
Figure 5B:
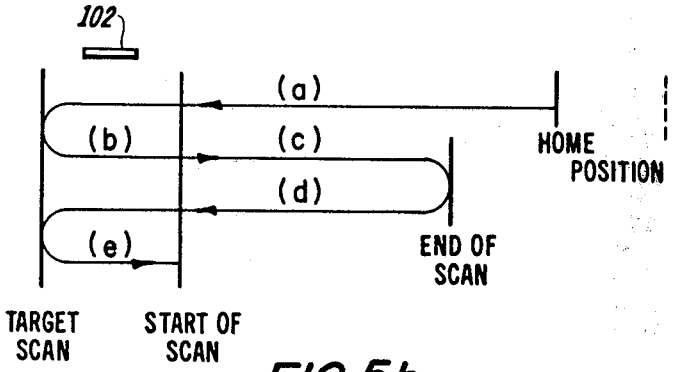
Figure 5C:
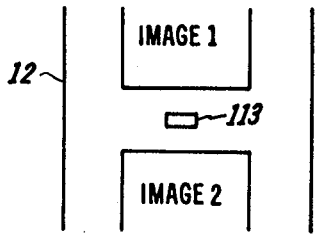
Figure 6:
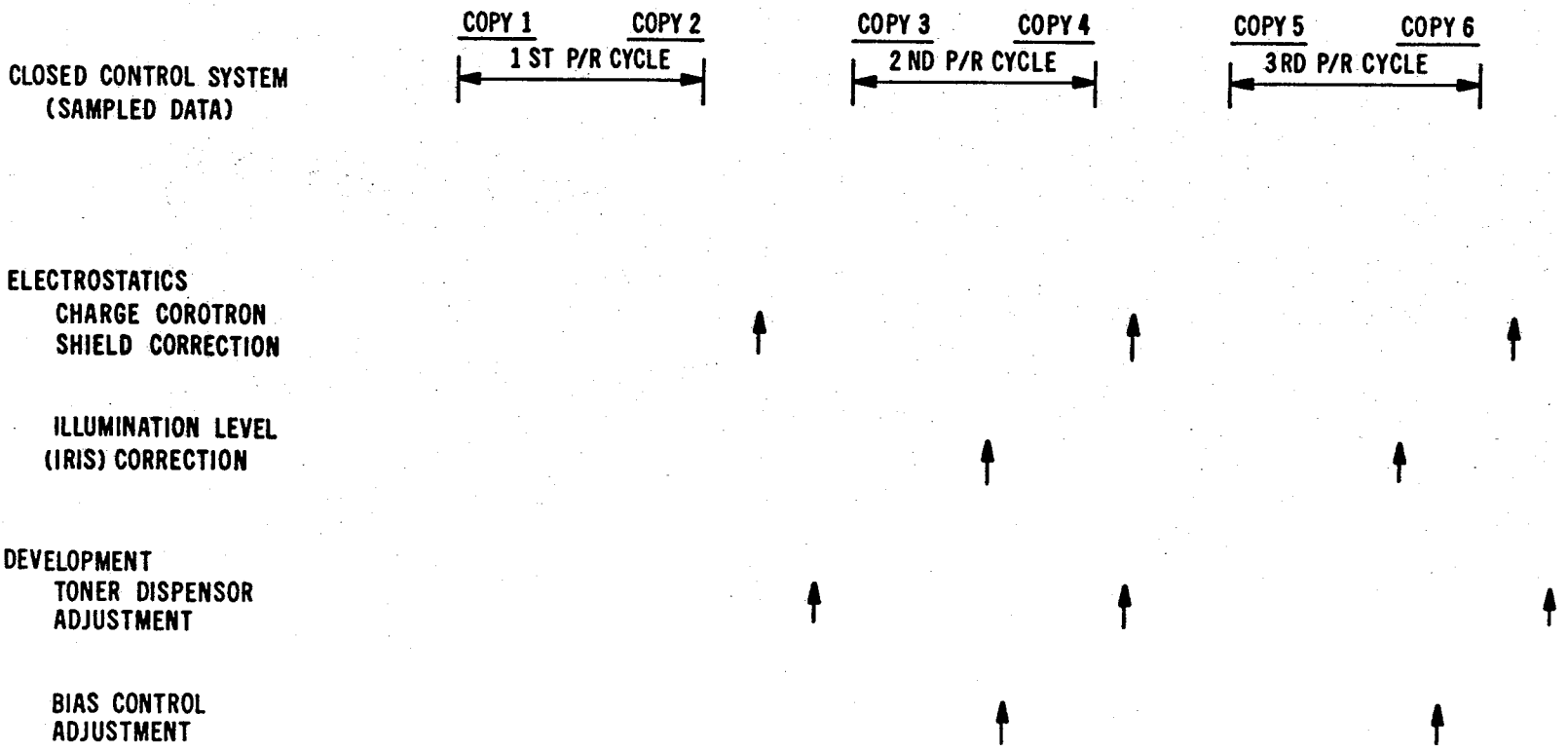
Figure 7:
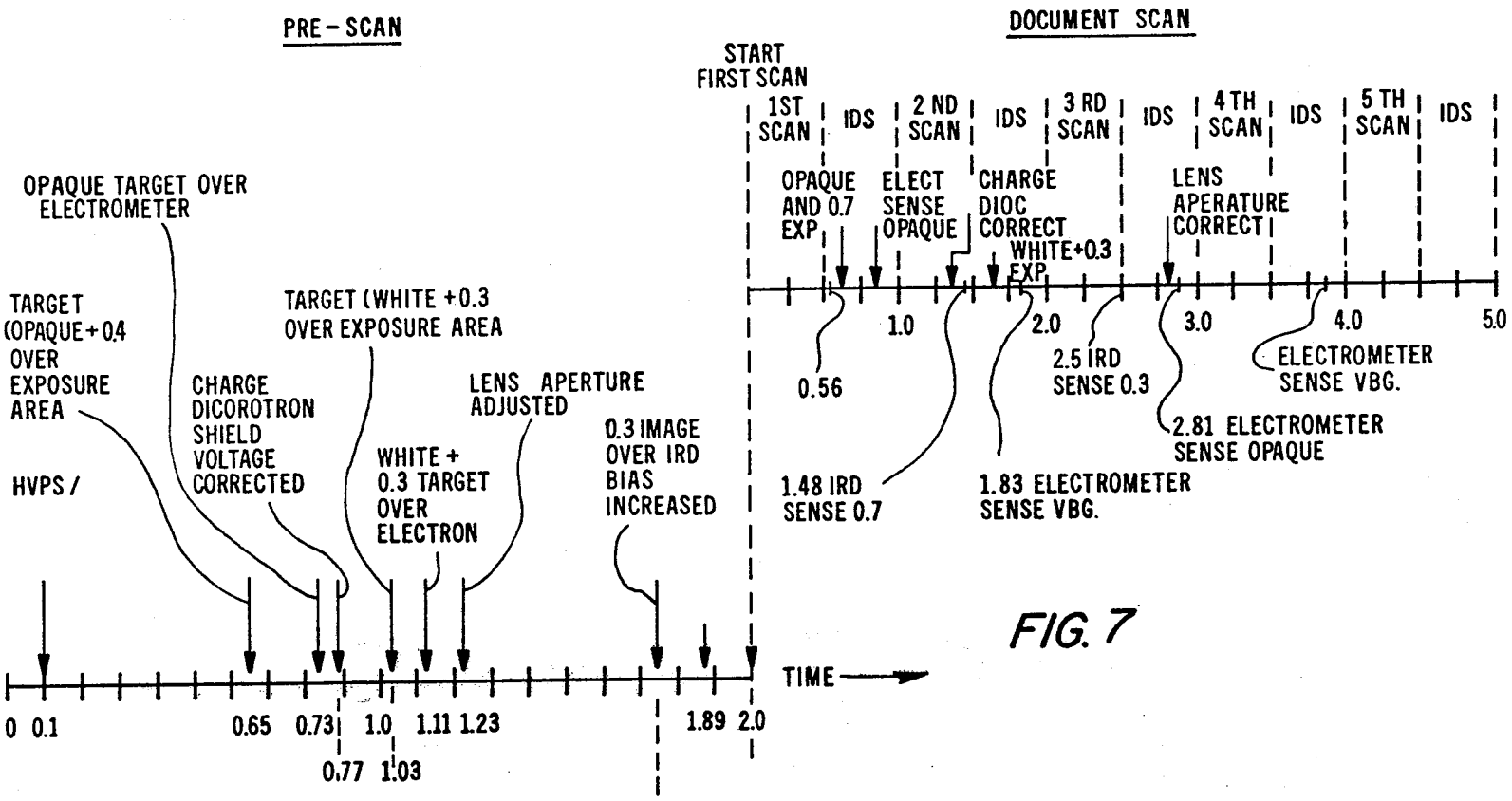
Figure 8:
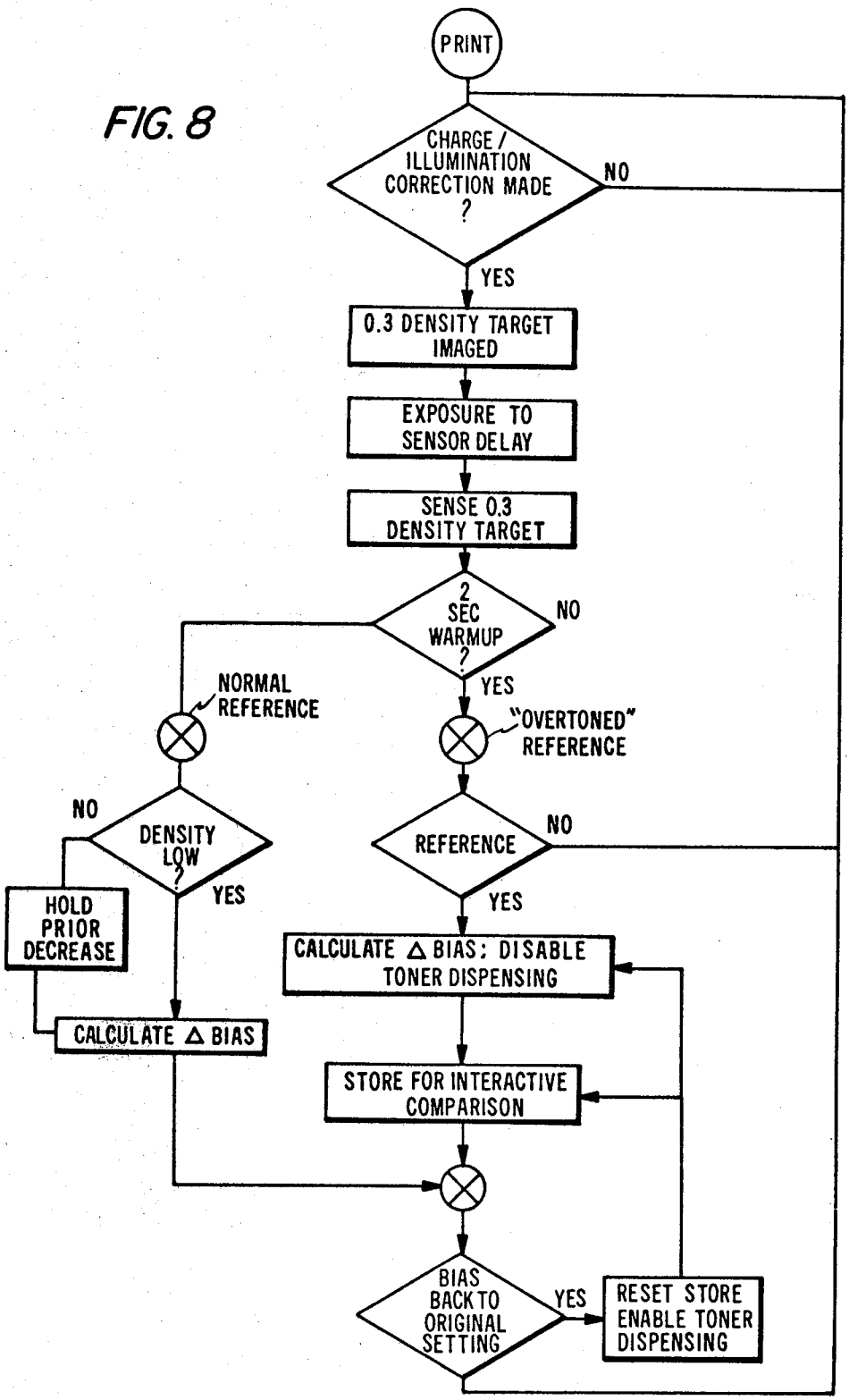
Figure 9:
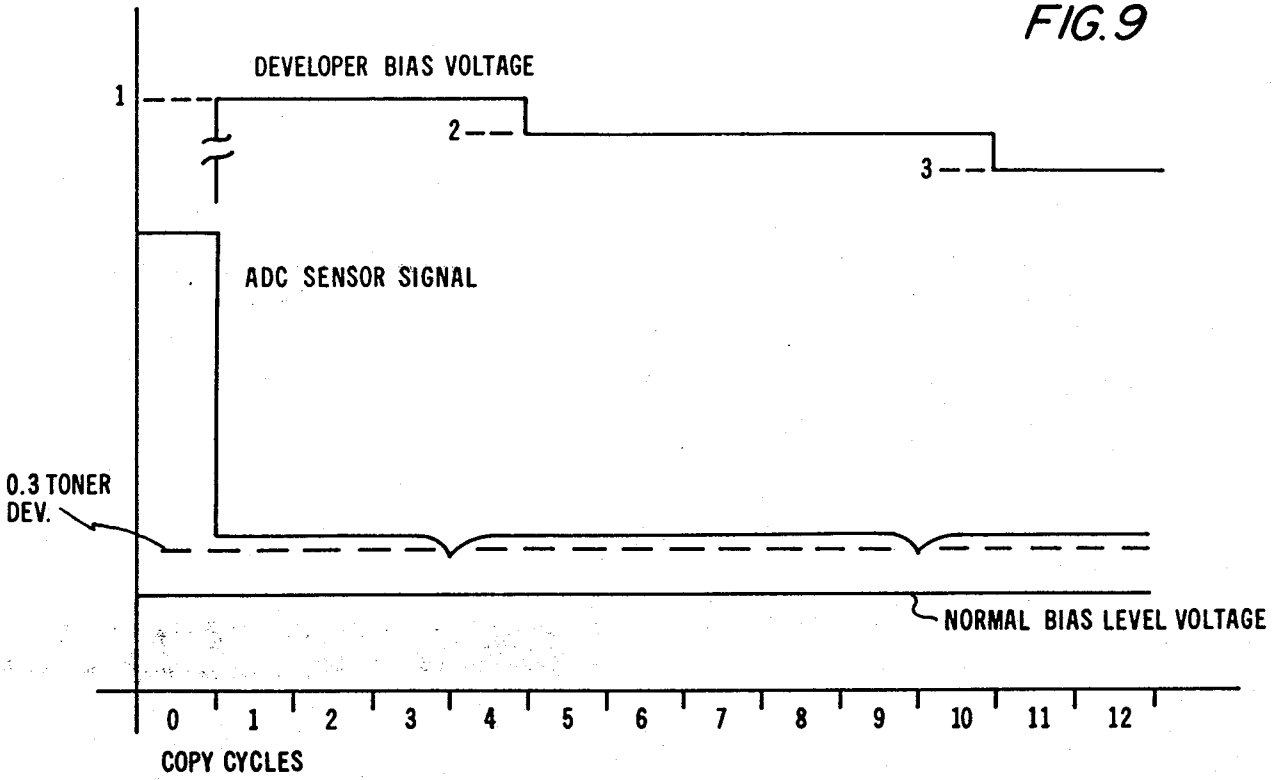
Figure 10:
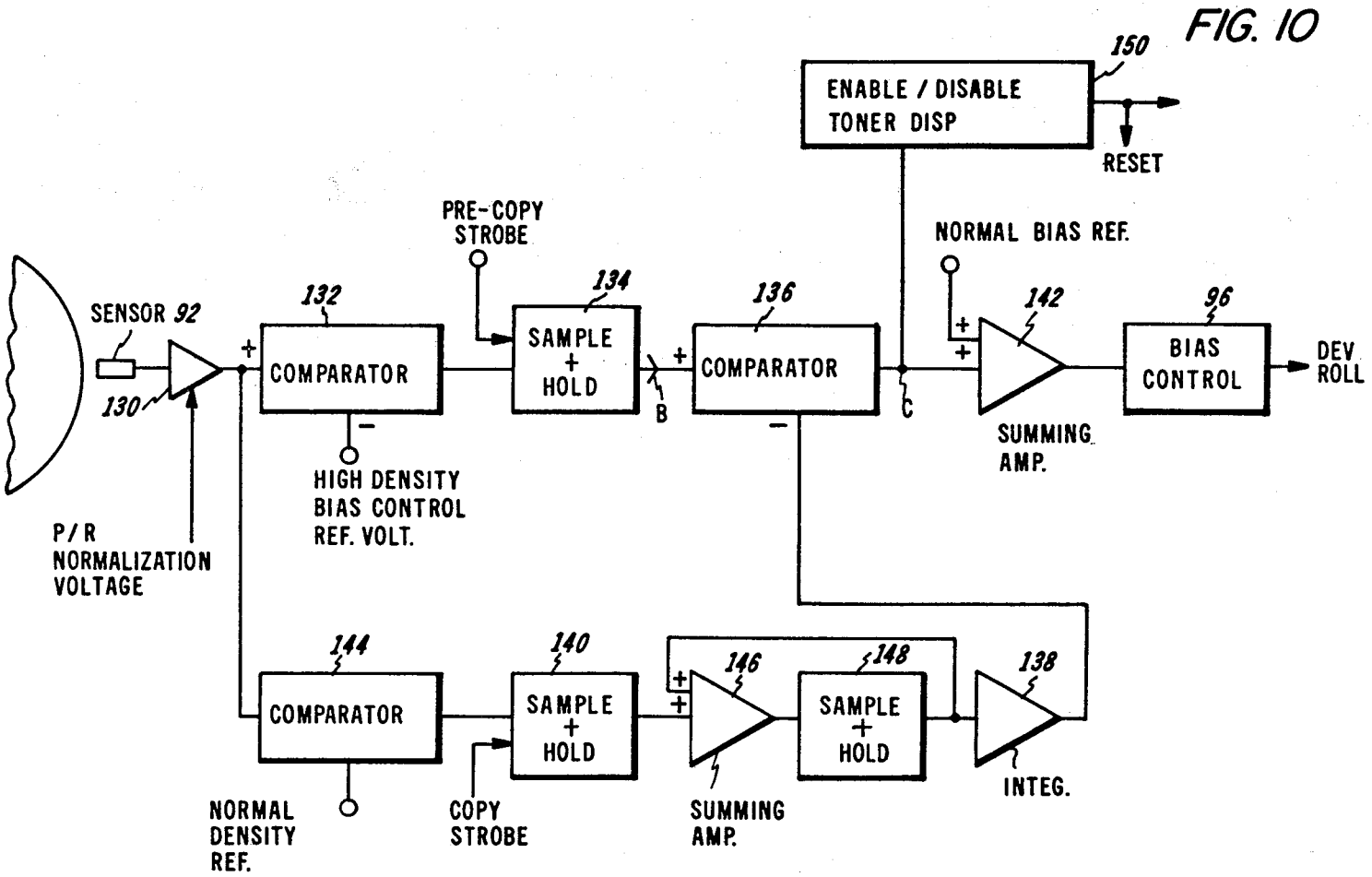

FIGS. 4*a* and 4*b* are detailed illustrations of the two test targets in accordance with the present invention;

FIGS. 5*a* and 5*b* illustrate the sequence document scan, and target prescan in accordance with the present invention;

FIG. 5*c* illustrates the image and target area relationship on the photoreceptor;

FIGS. 6 and 7 illustrate the timing sequences of the control loops illustrated in FIG. 2;

FIG. 8 is a flow chart of the bias control loop in accordance with the present invention;

FIG. 9 is a plot illustrating bias control;

FIG. 10 is a block diagram of the bias control circuitry in accordance with the present invention.

Figure 11:
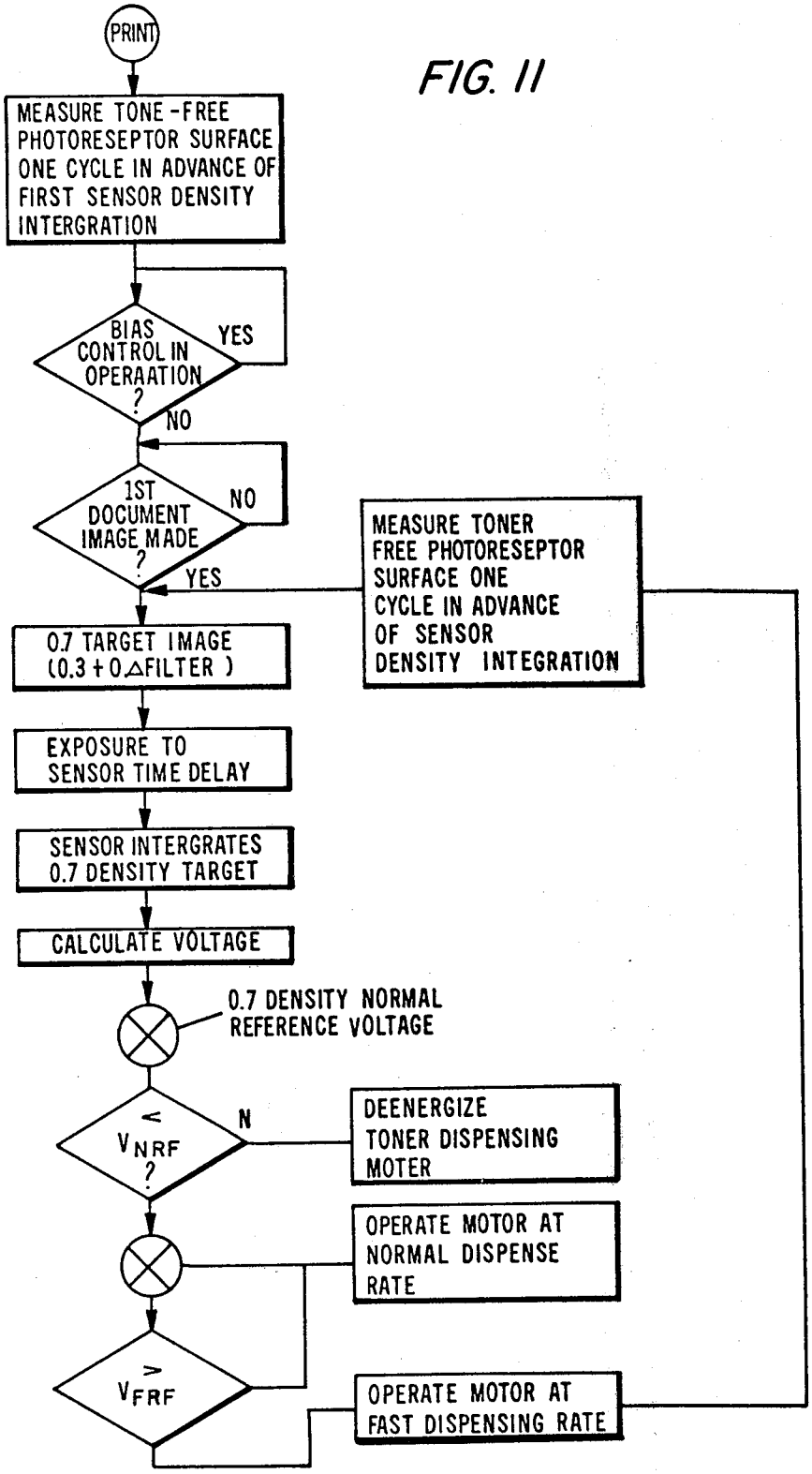
Figure 12:
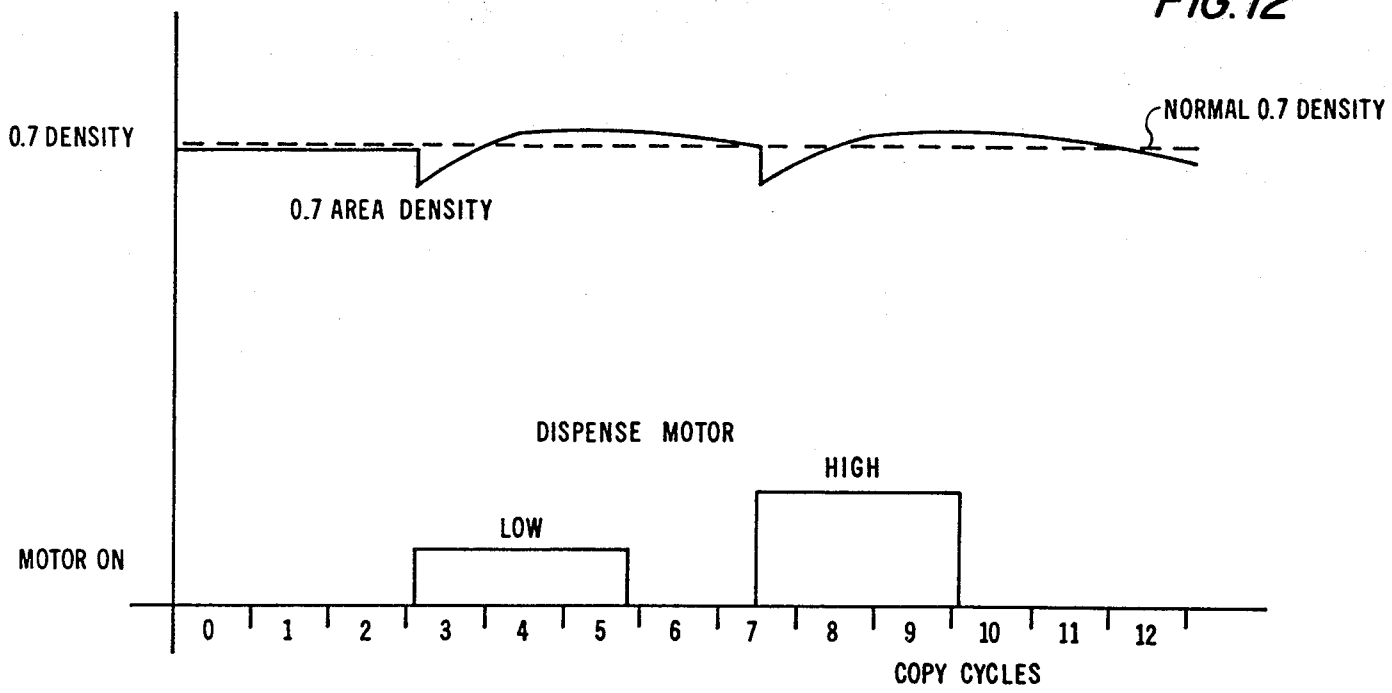

FIG. 11 is a flow chart of the toner dispensing control loop in accordance with the present invention; and FIG. 12 is a plot illustrating toner dispense control.

DETAILED DESCRIPTION

Figure 1:
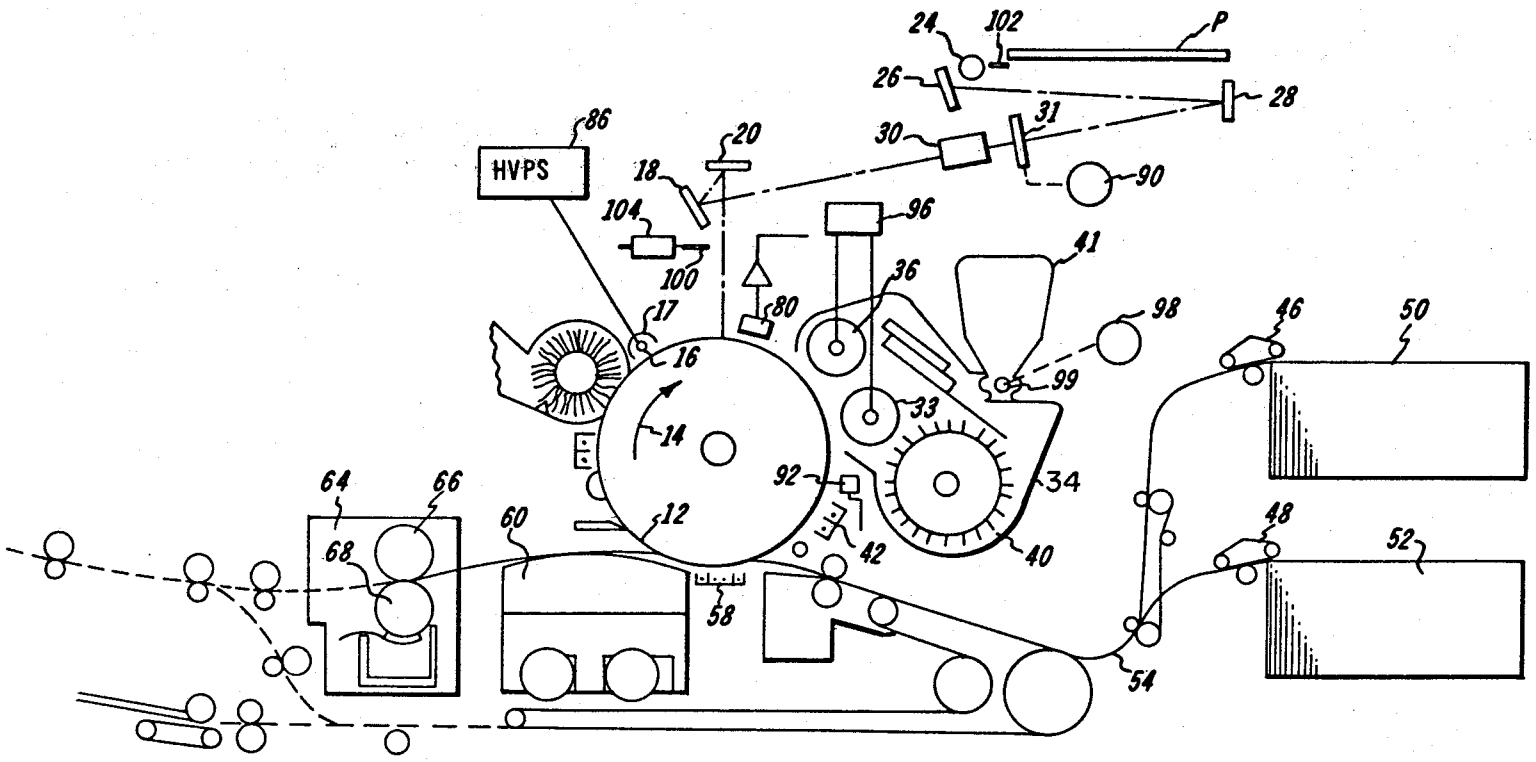
FIG. 1 is a pictorial of the apparatus incorporating the present invention.

For a general understanding of a reproduction machine in which the features of the present invention may be incorporated, reference is made to FIG. 1, depicting schematically the various printing machine components. A drum having a photoconductive surface 12 is rotated, in the direction of arrow 14 through a charging station. The charging station employs a corona generating device having a charging electrode 16 and conductive shield 17 positioned adjacent photoconductive surface 12 to charge photoconductive surface 12 to a relatively high uniform potential. A suitable corona generating device may be of the type described in U.S. Pat. No. 4,086,650 issued Apr. 25, 1978, the relevant portions thereof being incorporated into the present application.

The charged portion of photoconductive surface 12 is then rotated to an exposure station for producing a light image of an original document placed on platen P. In particular, lamp 24 illuminates incremental portions of the original document disposed on platen P in moving across the platen P. The light rays reflected from the original document are reflected by a full rate mirror 26 to a half rate mirror 28. Half rate mirror 28 reflects the light rays through iris 31 and lens 30 to mirrors 18 and 20. The surface 12 rotates in synchronism with the movement of the platen scanning optics.

As the surface 12 continues to rotate in the direction of arrow 14, the recorded electrostatic latent image is advanced to a development station including a housing 34 containing a supply of developer mix and a pair of developer rollers 36 and 38. Each developer roller includes a stationary magnetic member having a non-magnetic, rotatable tubular member interfit telescopically over the stationary member. The developer material is advanced to developer rollers 36 and 38 by paddle wheel 40 disposed in the sump of housing 34. Developer rollers 36 and 38 advance the developer mix into contact with the electrostatic latent image on surface 12. As successive electrostatic latent images are developed, the toner particles within the developer mix are depleted. Additional toner particles are stored in toner cartridge 41.

After the toner powder image has been developed on photoconductive surface 12, corona generating device 42 applies a charge to pre-condition the toner powder imge for transfer. A sheet of support material is advanced by sheet feeding apparatus 46 or 48 from either tray 50 or tray 52. Conveyer system 54 advances the sheet of support material to a transfer station including a corona generating device 58 for charging the underside of the sheet of support material to a level sufficient to attract the toner powder image from photoconductive surface 12.

After transfer of the toner powder image to the sheet of support material, a vaccum stripping system 60 separates the sheet from photoconductive surface 12 and advances it to a fusing station 64.

The fusing station 64 includes a heated fuser roll 66 in contact with a resilient backup roll 68. The sheet of support material advances between fuser roll 66 and backup roll 68 with the toner powder image contacting fuser roll 66. After the toner powder image has been permanently fused to the copy sheet, the copy sheets are advanced by a series of rollers to suitable (not shown) output trays.

In accordance with the present invention, in order to maintain copy quality and compensate for copy to copy density variations, there are provided two control loops, namely a a bias control loop, and a toner dispensing control loop.

With reference to FIGS. 1 and 2, in bias control, an infrared densitometer 92, is positioned adjacent to the photoreceptor surface 12 between the developer station and the transfer station. The densitometer 92 generates an electrical signal proportional to the toner mass of a 0.3 solid area density test patch developed on the photoreceptor surface 12. This signal is conveyed to controller 82 through suitable conversion circuitry 94. In response, the controller 82 activates a bias control or power supply 96 through logic interface 97. The bias control 96 is electrically connected to the rotatable tubular members of the developer rollers 36 and 38 to vary the electric field between the developer rollers and the photoreceptor to maintain constant developability.

In automatic development control (ADC), the signal generated by infrared densitometer 92 proportional to developed toner mass is conveyed to the controller 82 through conversion circuitry 94. In response, the controller 82 activates a dispenser roll control or motor 98 mechanically connected to dispenser roll 99 to convey toner from the cartridge 41 to the developer housing 34 to adjust toner concentration.

There are also provided two additional control loops, namely a charge control loop and an illumination control loop, forming no part of the present invention. In particular with reference to FIGS. 1 and 2, in charge control, a D.C. electrometer 80 is positioned adjacent to the photoreceptor surface 12 between the exposure station and development station. Electrometer 80 generates a signal proportional to the dark development potential on the photoreceptor surface. The generated signal is conveyed to controller 82 through suitable conversion circuitry 84. The controller 82 is also electrically connected to a high voltage power supply 86 through suitable logic interface 88 to control the bias voltage on the conductive shield 17 of the charging corotron to maintain a constant dark development potential.

In illumination control, the signal generated by the electrometer 80 is proportional to background potential on the photoreceptor surface is conveyed to controller 82 through suitable conversion circuitry, also represented by conversion circuitry 84. The background potential is the charge on the photoreceptor after exposure with light reflected from a white target or object. The controller 82 activates iris control motor 90 to change the mechanical position of the iris 31 to alter opening 91 and modulate the illumination level at the photoreceptor surface to maintain a constant background potential.

Figure 3:
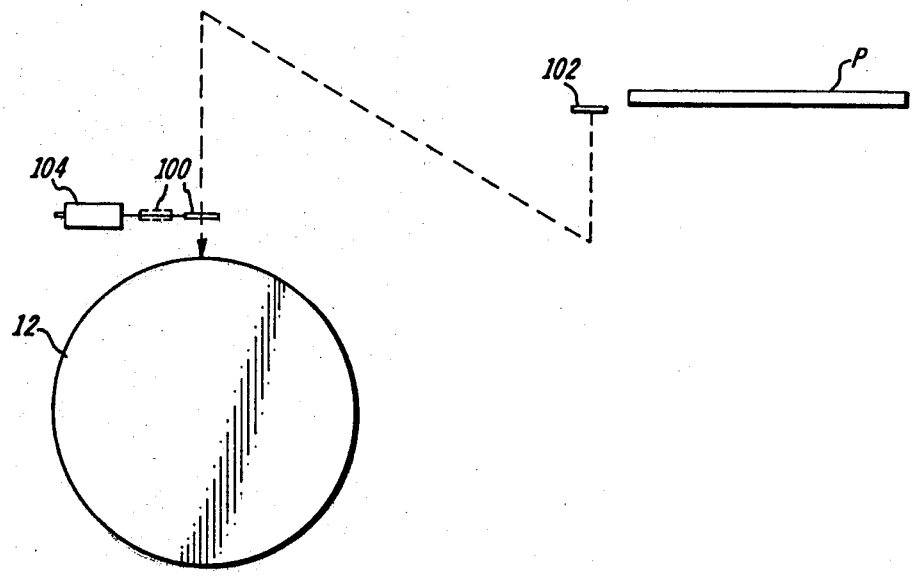
FIG. 3 is an illustration of the test targets according to the present invention in relation to the platen and photoreceptor surface shown in FIG. 1.

There is shown in FIGS 3, 4*a* and 4*b* a pair of test targets 100 and 102. Test target 100, located near the photoreceptor surface 12 is connected to solenoid 104 or any other suitable mechanism to position the target 100 into and out of the optical path illustrated in phantom at the photoreceptor surface 12 to block light from surface 12. Test target 102 is rigidly secured at the end of platen P and disposed to reflect light from exposure lamp 24 through the optical system to surface 12.

Test targets 100 and 102 are typically transmission filters with predetermined transmission characteristics. With reference to FIG. 4*a*, test target 100 is divided into an "opaque" target 106 having zero light transmission and target 108 having a 0.4 solid area density. Test target 102 shown in FIG. 4*b* is divided into a "white" target 110 providing total reflectivity of light and target 112 having 0.3 solid area density.

Targets 100 and 102 are imaged in the interdocument or interimage area on surface 12 of the photoreceptor drum before the start of a new document imaging cycle. That is, the targets are imaged on surface 12 in the space between successive latent images of documents. The target 100 is positioned to closely overlay with target 102 along the optical path such that the opaque and white targets 106, 110 are in alignment and the 0.4 and 0.3 density targets 108, 112 are in alignment along the optical path to provide a 0.7 solid area density target when needed. It shuld be noted that test targets 106 and 110 form no part of the present invention.

With reference to FIG. 5*a*, the scanning lamp 24 and mirror 26 are mechanically connected to a carriage 114. The position shown in dotted lines is the home or standby position of carriage 114 and the position shown in solid lines is the start of scan position. During scan, the motion of the carriage 114 is under control of a not shown servo controller.

With reference to FIG. 5*b*, there is illustrated a typical scanning sequence. In particular, there is an initialization scan before the first document scan. The carriage moves initially from the home position to the start of scan position illustrated at (a) and then from the start of scan position to the left underneath the target 102 and back to the start of scan position illustrated at (b). This provides the first image of the black target 106 and white target 110 on the photoreceptor surface 12. The carriage then scans from the start of scan position to the end of scan position. This is the initialization scan without a document on the platen P illustrated as (c). The carriage 114 then remains at the end of scan position until the initial document scan takes place. For the first document scan, the carriage first moves from the end of scan position to position start of scan (d) and then moves to the target scan position and back to start of scan, illustrated as (e) for a second target scan. Finally, the carriage 114 moves from the start of scan position to the end of scan position for the document scan.

The test targets are imaged in the interdocument area as seen in FIG. 5*c* to initiate the control loops. In particular, the photoreceptor surface 12 is illustrated as containing two document images, image 1 and image 2. The sample 113 is illustrated in the interdocument space between image 1 and image 2 and is that portion of the photoreceptor sensed by infrared densitometer 92 to provide the signals for control. In essence, the present invention is a sample data rather than continuous data control system permitting accurate sense and correction outside the document image area.

The timing sequence is illustrated with reference to FIG. 6. In general, one photoreceptor cycle represents two document images or two copies during the document imaging process.

After the start print button is activated, there is a prescan cycle with reference to FIGS. 5*b* and 7 in the following sequence. The target 100 is exposed. The opaque target 106 exposure is sensed at the electrometer 80, and then the charge dicorotron shield 17 voltage is adjusted to return the dark development potential to the desired setpoint in the next interdocument area. At this point, the 0.4 target 108, although imaged, is not used by the control system. As the scanning carriage 114 passes over the target 102, the white target 110 and 0.3 target 112 are exposed. Next, the white target exposure is over the electrometer 80 and in response to the electrometer voltage, the iris aperture 91 is adjusted. Then, in accordance with the present invention the 0.3 developed image reaches the IRD sensor 92 and in response to the IRD sensor 92, the bias control 96 is activated if required. There are two similar prescans before the first document is imaged providing a white target image, an opaque target image and a 0.3 target image. The purpose of the prescan sequence is to image the targets, reset the charge dicorotion shield, illumination level and developer bias if required and set the rate of scan of the scanning carriage.

A correction if needed for each of the control loops is made in the next interdocument area after a sense has been made. Corrections are not made in the image area to prevent copy quality non-uniformities. The corotron shield adjustment and toner dispense adjustment are made after copy one and copy two scans and after each photoreceptor cycle thereafter. The illumination level and bias control adjustments are made after the copy three scan, the first document scan of the second photoreceptor cycle. Thereafter the adjustments are made in the middle of successive photoreceptor cycles as shown in FIG. 6.

The scanning carriage 114 begins the first copy scan as illustrated in the right half of FIG. 7, and after completion of the first copy scan, the opaque and 0.4 targets are exposed in the inner document space (IDS). The opaque and 0.4 targets under solenoid control, are inserted in the optical path in the same position as the white and 0.3 targets during the overlap scan operation. In effect, therefore, an opaque and a 0.7 target will be exposed. With reference to FIG. 7, in the scan mode, before the start of the second scan, the exposed photoreceptor surface 12 will have moved to a position for sensing by the electrometer 80. The electrometer 80 will sense the opaque target 106 and at the end of the second scan in response to the electrometer 80, the charge dicorotron shield 17 voltage will be corrected. This is illustrated in FIG. 7 by the arrow indicating an adjustment at the end of the second document scan.

At the end of the second document scan, the photoreceptor surface 12 has moved into position for sensing of the 0.7 density target and the toner dispenser roll control 98 may be activated at this time if required if the system is no longer in the bias control mode. The system is either initially in the bias control mode to adjust developer bias to account for high humidity and the resultant high image density and background potentials or in the toner dispense control mode but never in the two modes simultaneously.

After the end of the second document scan, during the white target scan prior to beginning the third document scan, the white and 0.3 target areas are exposed in the interdocument space. Shortly after the exposure of the white target 110, the electrometer 80 senses the voltage representative of the white target image area in the interdocument space. Next, the carriage 114 scans the third document and toward the end of the third document scan, the 0.3 target 112 image area on the photoreceptor surface 12 and has moved into position for sensing by the IRD sensor 92. If in the bias control mode, the sensed toner image for the 0.3 target is used to adjust the bias control voltage. After the third document scan, in the interdocument space between the third and fourth copy scans, the iris aperture 91 is corrected in response to the white target image in the previous interdocument space. The correction is shown by the arrow in FIG. 7 after the document three scan. The sequence is then generally repeated.

In accordance with the present invention, the bias control and automatic development control (ADC) loops are responsive to signals generated by the infrared densitometer (IRD) sensor 92. The infrared densitometer 92 reflects light from the developed section and the reflected light is converted to an electrical signal.

For bias control with test target 100 retracted from the optical path, light will be projected from white target 110 and 0.3 density target 112 of test target 102. The image on the photoreceptor surface 12 corresponding to the 0.3 solid area target 112 will be developed with toner at the developer station and then sensed by IRD sensor 92. The signal produced by IRD sensor 92 is proportional to toner mass development on the portion of the photoreceptor surface 12 corresponding to the 0.3 solid area target image. This signal will be conveyed to controller 82. In response to this signal, controller 82 controls the bias on developer rolls 36 and 38 through bias control 96.

During the precopy scan cycle, controller 82 determines whether or not to initiate the bias control loop operation after the illumination and charge corotron adjustments have been made. Generally in conditions of high humidity and before machine warm up, an excessive amount of toner will be deposited on the photoreceptor during the development cycle. Developer material in electrographic machines commonly comprise a mixture of suitably pigmented particles known as toner and a granular carrier material carrying the toner by means of an electrostatic attraction. To dislodge the toner particles from the carrier, a suitable electrostatic field is provided between the photoreceptor surface and the toner. Preferably, this electrostatic field is provided by a suitable voltage or bias on the rotatable tubular members of the developer rollers at the development station. Generally, the higher or greater the developer roll bias, the greater the resistance to the attraction of toner to the photoreceptor surface.

The amount of toner desposited on the photoreceptor depends upn factors such as the electrostatic attraction between the toner and the carrier, the electrostatic field between the photoreceptor and the developer rollers and also the amount of toner contained within the developer housing. In high humidity conditions, the electrostatic attraction between the carrier and toner particles is reduced, resulting in an excessive deposit of toner on the photoreceptor. Also, initially, very little toner has been depleted from the developer housing.

An excessive amount of toner on the developed section, sensed by infrared densitometer 92, will result in an error signal. This error signal initiates an initial increase in the bias voltage to developer rolls 36 and 38. After this initial increase in bias, the bias control operation consists of lowering the bias voltage, when required, in step fashion down to the normal bias level while maintaining the desired output toner density. The bias level is lowered as the humidity in the developer sump decreases due to a general decrease in humidity outside the machine and due to internal machine warm up. Initially, raising the bias voltage increases the electric field between the developer and the photoreceptor surface and lowers the developed density to the desired level. As the humidity decreases, the electrostatic charge between the toner and carrier increases requiring that the bias level be reduced.

The sensing of the developed toner mass by infrared densitometer 92 is repeated during the copy cycle and the bias voltage is decreased, if required, in small step increments during the copy cycle to maintain the signal generated by the densitometer 92 within the desired limits. This indicates that the developed image solid area density is within acceptable limits. The lowering of the bias level ultimately to the normal bias level, as sensed by analog to digital circuitry, results in deactivation of the bias control.

In particular, with reference to FIG. 8, after the charge and illumination corrections have been made, the 0.3 density target is imaged and after a suitable delay, the developed image is sensed by the infrared densitometer 92. Initially, if a high humidity condition exists, there will be excessive toner on the photoreceptor surface and a signal exceeding an "overtoned" reference signal will be generated. This signal will cause the bias level to be initially raised to a voltage level above the nominal or normal bias voltage level, bringing the solid area density within the acceptable limits. The toner dispense control loop is deactivated during bias control operation to prevent addition of toner.

Thereafter, the infrared densitometer signal is compared to a normal reference signal or voltage. If the sensed voltage is not greater than the reference voltage, the developed image is at the proper solid area density and no change in bias control is initiated. If the sensed voltage, however, is greater than the reference voltage indicating an unacceptably high image density, a decrease in bias voltage is performed. The new bias is determined and stored. The adjusted bias voltage is at a level which provides the proper developed image density. In other words, during the copy cycles, a sensed voltage from the 0.3 density target is compared to a normal density reference and if the density is low, the bias level is decreased by a small increment. The lower developed image density is due to greater electrostatic charge attraction between the toner and carrier during machine warm up and due to toner depletion since the toner dispense control is disabled. The comparison of the densitometer 92 signal with the reference, the removal of the low charged toner to the copy paper and the stepping down of developer bias is repeated during the copy cycle until the bias is decremented to the normal setting. At this point, the toner dispense system is enabled and bias control disabled.

The 0.3 solid area density target is sensed once every photoreceptor cycle or two copy cycles. Initially, with reference to FIG. 9 during the precopy scan, because of the high humidity condition, there will be an excessive amount of toner deposited on the photoreceptor. This will produce a relatively high sensor signal by IRD sensor 92 shown in a solid line in the bottom graph labeled ADC sensor signal, the bottom solid line. The dotted line represents normal bias level voltages. The ADC sensor signal will be monitored and result in the generation of a very high developer roll bias level 1 on the top graph showing bias voltage to inhibit the attraction of toner particles to the photoreceptor. For the next 0.3 solid area density test reading, much less toner will be attracted to the test patch and a normal or near normal test signal will be generated by the IRD sensor 92. For a period of time as shown by four copy cycles in the graph, the normal amount of toner will be deposited on the test patch to maintain a 0.3 solid area development. However, as the machine warms up, moisture is driven from the developer sump and there is a greater attraction between the toner and carrier.

Thus, it will be more difficult to attract the desired amount of toner onto the photoreceptor and eventually as shown in the graph, there will be a reading from the IRD sensor 92 indicating less than desired amount of toner deposited on the photoreceptor. Also contributing to the lesser amount of toner on the photoreceptor is the fact that toner is being depleted from the developer housing while the toner dispense control is disabled. At this point, as shown at the end of the copy 4 cycle on the graph, the response is to lower the bias to level 2 on the developer rollers. The lower the bias, the greater the attraction or field between the photoreceptor and the developer rolls to attract the toner particles onto the photoreceptor. This will increase the amount of toner on the photoreceptor to within the desired 0.3 solid area development level.

This sequence will continue with the developer bias being decreased in step increments as the moisture is driven from the developer sump and the toner in the housing is depleted until the bias level has been reduced to the normal bias level. The step decrements are necessarily small to prevent unacceptable density variations within the copy. When the developer bias has been reduced to the normal level, the bias control is disabled and the toner dispense control is enabled.

With reference to FIG. 10, a reading is made by the ADC sensor 92 of the developed patch corresponding to the 0.3 density target. This signal is conveyed through an amplifier 130 to the precopy comparator 132. The signal is compared with a high density bias control reference voltage. In particular, if there is an excessive amount of toner deposited on the photoreceptor before machine warmup due to high humidity morning conditions, a high density signal will be generated by sensor 92. This signal is compared to the high density reference voltage and if the sensed signal exceeds this reference voltage level, a suitable signal is conveyed to precopy sample and hold circuitry 134. This comparison step is illustrated at decision block A in FIG. 8.

The sample and hold circuitry 134 is enabled by a precopy strobe signal. The output of the precopy sample and hold 134 circuitry is one input to the bias control comparator 136. The other input to the comparator 136 is the output of an integrater circuit 138. In the precopy scan, however, there is no output of the integrater circuit 138 because the copy cycle sample and hold circuitry 140 will receive an enabling signal only in the copy scan sequence.

Therefore, in the precopy scan, the output of the bias control comparator 136 manifesting a high toner density condition, is conveyed to a summing amplifier 142. The summing amplifier 142 adds a high density condition voltage to the normal bias reference voltage to provide a significantly high bias voltage to the bias control 96 controlling the developer rolls. This high bias compensates for the high humidity, high toner density conditions. This condition is illustrated by signal B from sample and hold circuitry 134 in FIG. 10. At this condition the toner dispense control is disabled. If there were no high density toner condition, and the threshold level in the precopy comparator 132 was not exceeded, the output of the bias control comparator 136 to the summing amplifier 142 would be essentially zero and the bias control 96 would provide only the normal bias reference voltage. This is the normal condition after machine warm up.

After the precopy scan, there is the normal copy scanning mode. Therefore, there is no precopy strobe pulse to the sample and hold circuitry 134 and therefore no output from the sample and hold circuitry 134 to the comparator 136. Instead, there is a copy strobe pulse to the copy cycle sample and hold circuitry 140. The signal from sensor 92 is compared with a normal density reference signal in the copy cycle comparator 144 since the bias level had already been adjusted during the precopy scan in response to the high toner density signal B. The adjustment to the bias control 96 will provide a correct 0.3 density reading by sensor 92. Therefore, the sensor 92 signal upon comparison with the normal density reference signal in the copy cycle comparator 144 will provide an essentially zero output signal to the sample and hold circuitry 140.

Eventually, however, the lower humidity conditions due to machine warm up and the depletion of the toner from the developer housing will cause a lower toner density signal to be generated by sensor 92. The output of the copy cycle comparator 144 to the sample and hold circuitry 140 will then indicate the low toner density condition. This signal conveyed through the summing amplifier 146 and feedback sample and hold circuitry 148 to the integrator 138 will provide a negative signal to the bias control comparator 136. The output of the comparator 136 will then be a less positive signal conveyed to the summing amplifier 142 than was conveyed in response to the high density toner condition. This signal is added to the normal bias reference voltage and results in less bias voltage applied to the developer rolls by the bias control 96. If the density level for the next copy scan cycle is normal, the output of the copy cycle comparator 144 will again be an essentially zero voltage signal to the sample and hold circuitry 140. The output of the summing amplifier 146 will, therefore, only be equivalent to the feedback signal from the feedback sample and hold circuitry 148. This signal is the equivalent to the first indication of a low density condition and therefore the same magnitude signal is applied from the integrator circuit 138 to the bias control comparator 136, thus maintaining the same level of bias control.

In a similar fashion, each low toner density measurement signal will provide a step decrease signal from the integrator circuit 138 to the bias control comparator 136 and in turn will decrease the bias on the developer rollers by the bias control 96. Eventually, as the machine warms up and the moisture is driven from the environment, the developer roll bias will be reduced to the normal bias reference voltage. At this point, a signal from the bias control comparator 136 to the enable/disable toner dispenser control 150 will enable the toner dispense control. The output of this control is also used to reset all the sample and hold control circuits.

The ADC or toner dispense control is responsive to signals generated by the IRD sensor 92 in response to a 0.7 solid area density target being developed on the photoreceptor surface 12. The IRD sensor signal is generated as a result of test target 100 being inserted into the optical path resulting in the overlapping of the 0.4 solid area density target 108 and the 0.3 solid area density target 112 and the subsequent development of the composite image on the photoreceptor surface 12 at the developer station. The signals generated by the IRD sensor 92 are representative of the amount of toner mass on the surface 12 corresponding to the 0.7 solid area image. The signal is conveyed to controller 82 and in response, the controller 82 controls a motor or dispenser roll control 98. The dispenser control motor 98 activates a dispenser roll 99 to supply additional toner particles from the cartridge 41 to the developer housing 34 on a controlled duty cycle basis.

In operation, with reference to FIG. 11, a toner free photoreceptor surface measurement is made one photoreceptor cycle in advance of the first IRD sensor 92 density measurement in the same position that the 0.7 test patch will be developed. This signal is stored and utilized to compensate for photoreceptor substrate reflectivity differences that would contribute an error in the IRD sensor 92 signal generated. The IRD sensor 92 senses the photoreceptor area without toner, at a position where the test target will be developed one photoreceptor revolution later, to normalize out circumferential photoreceptor substrate reflectivity variations and the resultant IRD sensor 92 signal errors. Normalization is periodically performed during the copy run at twelve copy or three photoreceptor revolution intervals when the "clean drum" area coincides with 0.7 test target development area. This signal is stored in memory as a clean drum signal and is updated preferably every twelve copies and at the start of a new copy run.

A signal from the controller 82 activates the solenoid for inserting the 0.4 test target into the optical path at the photoreceptor surface 12 when the lamp 24 reaches the target scan position. A 0.7 density area target is imaged and the image then travels to the sensor 92 and the sensor interrogates the 0.7 density developed sample and transmits the analog signal through a suitable amplifier and buffer stage and A/D converter to the controller 82. The signal is then compared with the 0.7 density normal reference voltage stored in the suitable controller memory. If the sensed voltage is greater than the normal reference voltage ($V_{NRF}$), the toner dispense motor 98 is shut off. On the other hand, if the voltage is less, the toner dispense motor 98 is then driven to dispense toner at either a normal or high rate in response dependent on the degree to which the signal is less than the threshold ($V_{FRF}$) signal which is also stored in non volatile memory.

With reference to FIG. 12, there is illustrated a plot in the top graph of the 0.7 area density signal generated by the IRD sensor. The dotted line represents the desired b 0.7 density signal. The bottom graph illustrates two speeds of a toner dispense motor. As shown in FIG. 6, the corrections for the toner dispenser are made preferably at the end of copy cycle 2, copy cycle 4 and every even copy cycle if required. For example, as shown in the top graph, at the end of the second copy cycle, there is shown a step decrease below the normal 0.7 density signal. The toner dispenser motor is normally off. If the signal generated by the IRD sensor indicates low toner density below the normal 0.7 density, it is necessary to activate the toner dispenser motor.

In this case, the lower graph at the end of copy cycle 2 shows the activation of the dispense motor at the low speed. The motor remains on delivering toner to the developer housing until the IRD sensor 92 indicates an amount of toner density sufficiently greater than the normal 0.7 toner density. At this point the dispense motor is shut off and as the machine continues to make copies and use up toner, the toner density may decrease until a point as shown in the lower graph. That is, after the copy cycle 6, the 0.7 density has fallen to a point below the normal 0.7 density requiring activation of the dispense motor. The lower graph shows that during copy cycle 7, the dispense motor is activated at the high speed again adding toner to the developer housing until the point where the signal generated by the IRD sensor indicates a toner density well above the normal 0.7 density. This process continues with the dispense motor being activated as required and the adjustment or activation of the toner dispenser being made, if required, preferably after each even copy cycle.

The dispensing of toner from the hopper is accomplished by movement dispenser roll 99 which rolls toner from the cartridge to the sump. By activating the motor 98 a given amount of time the dispenser roll 99 will deliver a given amount of toner.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A sample data developer control in a reproduction machine having a developer and a photoreceptor surface supporting toner images comprising a bias control electrically connected to the developer, a first comparator electrically connected to the bias control, a test target for providing a sample image on the photoreceptor in the photoreceptor image area, means for developing the sample image, means for indicating a first toner density condition on the sample image, the means for indicating being electrically connected to the comparator, the bias control responding to the first toner density condition to change the bias on the developer to provide a second toner density condition on the image, means for periodically indicating a toner density image deviating from the second toner density condition, the means for periodically indicating being electrically connected to the comparator, the bias control being responsive to the comparator to maintain the second toner density condition.

2. The developer control of claim 1 including a summing amplifier electrically connected to the bias control, one input to the summing amplifier being the output of the comparator, another input to the summing amplifier being the second toner density bias reference voltage.

3. The developer control of claim 1 wherein the means for indicating the first toner density condition includes a second comparator, a high toner density reference voltage, and sample and hold circuitry including a precopy strobe signal.

4. The developer control of claim 1 wherein the means for periodically indicating a toner density image deviating from the second toner density images condition includes a third comparator, an integrator circuit, and sample and hold circuitry including copy strobe signals.

* * * * *